US008251484B2

(12) United States Patent
Mizes

(10) Patent No.: US 8,251,484 B2
(45) Date of Patent: Aug. 28, 2012

(54) METHOD AND SYSTEM FOR MEASURING AND COMPENSATING FOR SENSITIVITY AND BACKLASH IN ELECTRICAL MOTORS THAT LATERALLY MOVE PRINTHEADS IN A CONTINUOUS WEB INKJET PRINTER

(75) Inventor: Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 315 days.

(21) Appl. No.: 12/780,676

(22) Filed: May 14, 2010

(65) Prior Publication Data

US 2011/0279504 A1 Nov. 17, 2011

(51) Int. Cl.
*B41J 29/393* (2006.01)

(52) U.S. Cl. ..... 347/19; 73/468

(58) Field of Classification Search ..... 347/19; 73/54.28, 54.35, 468
See application file for complete search history.

(56) References Cited

U.S. PATENT DOCUMENTS

| | | | | |
|---|---|---|---|---|
| 4,710,691 | A | 12/1987 | Bergstrom et al. | |
| 4,855,564 | A | 8/1989 | Hawkins et al. | |
| 5,015,935 | A | 5/1991 | Iwashita | |
| 5,410,338 | A | 4/1995 | Jadrich et al. | |
| 5,424,960 | A | 6/1995 | Watanabe et al. | |
| 5,513,919 | A | 5/1996 | Hevenor | |
| 5,598,201 | A | 1/1997 | Stodder et al. | |
| 5,608,430 | A | 3/1997 | Jones et al. | |
| 5,609,058 | A | 3/1997 | Gnadt et al. | |
| 5,742,144 | A | 4/1998 | Kato et al. | |
| 5,764,018 | A | 6/1998 | Liepe et al. | |
| 6,030,066 | A * | 2/2000 | Li et al. | 347/19 |
| 6,107,771 | A | 8/2000 | Maeda | |
| 6,161,914 | A | 12/2000 | Haselby | |
| 6,241,334 | B1 | 6/2001 | Haselby | |
| 6,249,300 | B1 | 6/2001 | Kerr et al. | |
| 6,419,343 | B1 | 7/2002 | Taylor et al. | |
| 6,513,904 | B1 | 2/2003 | Taylor et al. | |
| 6,527,359 | B1 | 3/2003 | Otsuki | |
| 6,563,601 | B1 | 5/2003 | Yamada et al. | |
| 6,568,782 | B1 | 5/2003 | Haselby | |
| 6,701,212 | B2 | 3/2004 | Shiba et al. | |
| 6,859,747 | B2 | 2/2005 | Yutkowitz | |
| 6,865,499 | B2 | 3/2005 | Yutkowitz | |
| 6,883,892 | B2 * | 4/2005 | Sievert et al. | 347/19 |
| 6,903,527 | B2 | 6/2005 | Toyozawa et al. | |
| 6,949,905 | B2 | 9/2005 | Tomatsuri et al. | |
| 6,986,615 | B2 | 1/2006 | Moore et al. | |
| 7,363,109 | B2 | 4/2008 | Jiang | |
| 2003/0026640 | A1 | 2/2003 | Moore et al. | |
| 2004/0145333 | A1 | 7/2004 | Toyozawa et al. | |
| 2007/0001641 | A1 | 1/2007 | Lewis et al. | |
| 2007/0138990 | A1 | 6/2007 | Lewis et al. | |
| 2010/0013882 | A1 | 1/2010 | Mizes et al. | |

* cited by examiner

*Primary Examiner* — Lamson Nguyen
(74) *Attorney, Agent, or Firm* — Maginot, Moore & Beck, LLP

(57) ABSTRACT

A method of operating a printer enables a controller in the printer to operate electrical motors for aligning printheads in the printer with greater accuracy. The method includes generating a test pattern on media with a plurality of printheads, identifying a first position for each printhead in the plurality of printheads from test pattern image data, operating an electrical motor operatively connected to one of the printheads to move the printhead in a first direction in the cross-process direction by a predetermined distance, generating a second test pattern on the media, identifying a second position for each printhead, comparing the second position of the printhead with the first position of the printhead to measure a distance moved by the printhead, identifying a first calibration parameter with reference to the predetermined distance and measured distance, and operating the electrical motor with reference to the first calibration parameter.

21 Claims, 7 Drawing Sheets

METHOD AND SYSTEM FOR MEASURING AND COMPENSATING FOR SENSITIVITY AND BACKLASH IN ELECTRICAL MOTORS THAT LATERALLY MOVE PRINTHEADS IN A CONTINUOUS WEB INKJET PRINTER

TECHNICAL FIELD

This disclosure relates generally to printhead alignment in an inkjet printer having one or more printheads, and, more particularly, to the electrical motors used to align the printheads in a continuous web inkjet printer.

BACKGROUND

Ink jet printers have printheads that operate a plurality of inkjets that eject liquid ink onto an image receiving member. The ink may be stored in reservoirs located within cartridges installed in the printer. Such ink may be aqueous ink or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer. In some printing systems, an image of a printed image is generated by printing the printed image onto media or by transferring the printed image onto media, ejecting the media from the system, and then scanning the image with a flatbed scanner or other known offline imaging device. This method of generating a picture of the printed image suffers from the inability to analyze the printed image in situ and from the inaccuracies imposed by the external scanner. In some printers, a scanner is integrated into the printer and positioned at a location in the printer that enables an image of an ink image to be generated while the image is on media within the printer or while the ink image is on the rotating image member. These integrated scanners typically include one or more illumination sources and a plurality of optical detectors that receive radiation from the illumination source that has been reflected from the image receiving surface. The radiation from the illumination source is usually visible light, but the radiation may be at or beyond either end of the visible light spectrum. If light is reflected by a white surface, the reflected light has the same spectrum as the illuminating light. In some systems, ink on the imaging surface may absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the intensity of the reflected light received by the detector. The electrical signals from the optical detectors may be converted to digital signals by analog/digital converters and provided as digital image data to an image processor.

The environment in which the image data are generated is not pristine. Several sources of noise exist in this scenario and should be addressed in the registration process. For one, alignment of the printheads can deviate from an expected position significantly, especially when different types of imaging surfaces are used or when printheads are replaced. Additionally, not all inkjets in a printhead remain operational without maintenance. Thus, a need exists to continue to register the heads before maintenance can recover the missing jets. Also, some inkjets are intermittent, meaning the inkjet may fire sometimes and not at others. Inkjets also may not eject ink perpendicularly with respect to the face of the printhead. These off-angle ink drops land at locations other than were they are expected to land. Some printheads are oriented at an angle with respect to the width of the image receiving member. This angle is sometimes known as printhead roll in the art. The image receiving member also contributes noise.

Specifically, structure in the image receiving surface and/or colored contaminants in the image receiving surface may be identified as ink drops in the image data and lightly colored inks and weakly performing inkjets provide ink drops that contrast less starkly with the image receiving member than darkly colored inks or ink drops formed with an appropriate ink drop mass. Thus, improvements in printed images and the analysis of the image data corresponding to the printer images are useful for identifying printhead orientation deviations and printhead characteristics that affect the ejection of ink from a printhead. Moreover, image data analysis that enables correction of printhead issues or compensation for printhead issues is beneficial.

One factor affecting the registration of images printed by different groups of printheads is printhead alignment. In some printers, multiple printheads are configured to enable the printheads to print a continuous line or bar on media in a cross-process direction. Aligning the printheads so the nozzles at one end of a printhead, such as the right end of the printhead, are spaced from nozzles at the other end of another printhead, such as the left end of the printhead, by a distance that is approximately the same as adjacent nozzles within a printhead. Alignment is also important for printheads that are arranged in a column to enable a second printhead in the column in the process direction to eject ink drops onto or next to ink drops ejected by a first printhead in the column. Consequently, detecting misalignment of printheads and measuring the distance required to compensate for the misalignment is important for image quality.

SUMMARY

A method of operating a printer enables a controller to align printheads in the printer to compensate for sensitivity and backlash in the electrical motors that move the printheads. The method includes generating a first plurality of dashes on media with a plurality of printheads as the media moves past the plurality of printheads, identifying a first position for each printhead in the plurality of printheads from image data of the first plurality of dashes, operating at least one electrical motor operatively connected to at least one of the printheads in the plurality of printheads to move the at least one printhead in a first direction in the cross-process direction by a predetermined distance, generating a second plurality of dashes on media with the plurality of printheads as the media moves past the plurality of printheads, identifying a second position for each printhead in the plurality of printheads from image data of the second plurality of dashes, comparing the second position of the at least one printhead with the first position of the at least one printhead to measure a distance moved by the at least one printhead, identifying a calibration parameter for the at least one electrical motor with reference to the predetermined distance and measured distance, and operating the at least one electrical motor with reference to the calibration parameter.

A printer is configured to use the method to align printheads in the printer to compensate for sensitivity and backlash in the electrical motors that move the printheads. The printer includes a media transport that is configured to transport media through the printer in a process direction, a plurality of printheads configured to eject ink onto media being transported past the plurality of printheads by the media transport, at least one electrical motor operatively connected to at least one printhead in the plurality of printheads, an imaging device mounted proximate to a portion of the media transport to generate image data corresponding to a cross-process portion of the media being transported through the printer in the process direction after the media has received ink ejected from the printheads, and a controller operatively connected to the imaging device, the at least one electrical motor, and the plurality of printheads, the controller being configured to operate the printheads to eject ink onto media to form a first plurality of dashes as the media is being transported past the printheads on the bars, to receive image data of the media and the ink ejected onto the media generated by the imaging device, to operate the at least one electrical motor to move the at least one printhead in a cross-process direction with reference to the media, and to process the image data to identify a calibration parameter for the at least one electrical motor with reference to a first position for the at least one printhead that is identified before the at least one electrical motor is operated to move the at least one printhead and to a second position for the at least one printhead that is identified after the at least one electrical motor is operated to move the at least one printhead.

BRIEF DESCRIPTION OF THE DRAWINGS

The foregoing aspects and other features of a printer that generates a test pattern to identify electrical motor characteristics in moving printheads are explained in the following description, taken in connection with the accompanying drawings.

DETAILED DESCRIPTION

Figure 6:
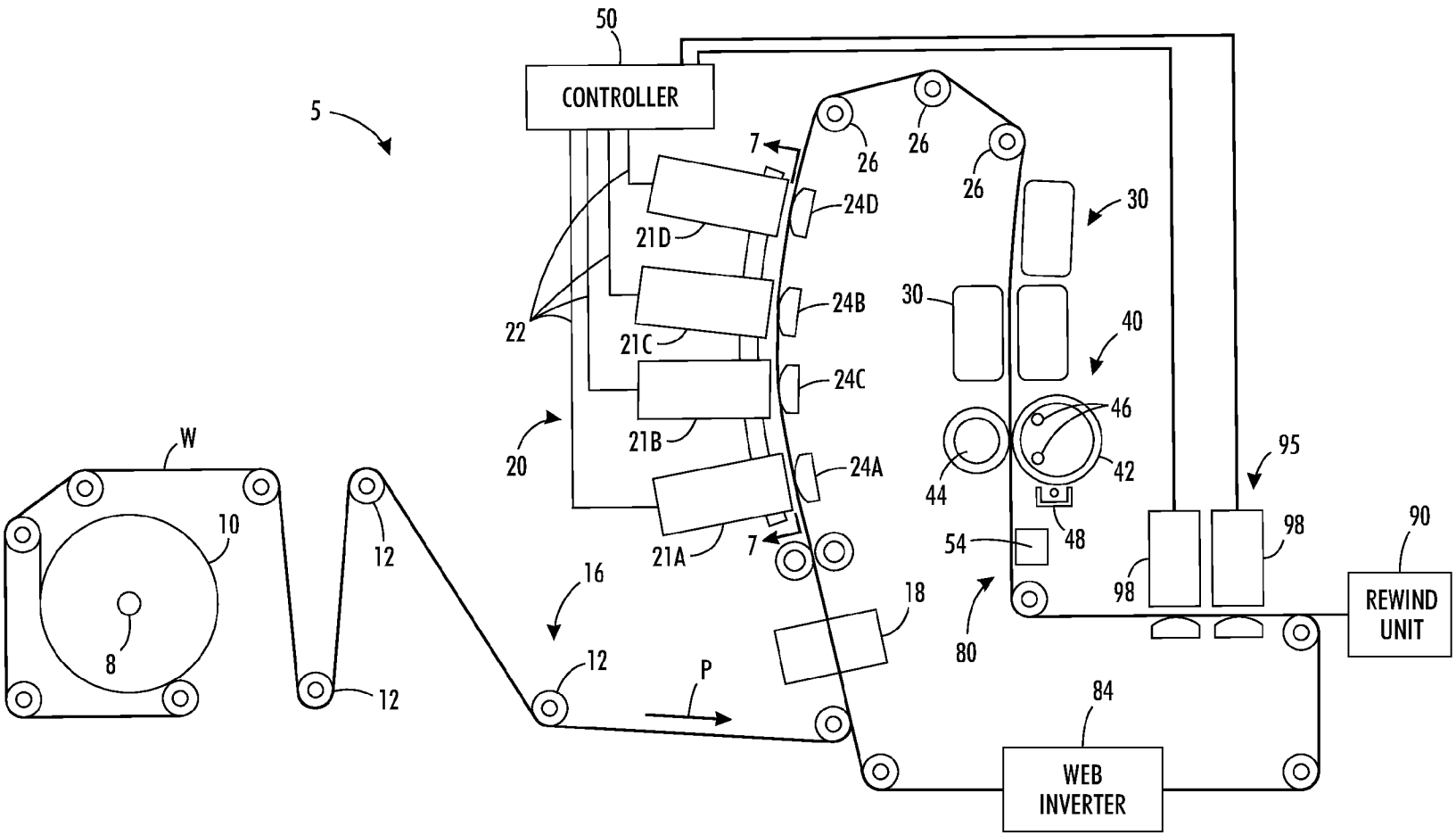
FIG. 6 is a schematic view of an improved inkjet imaging system that ejects ink onto a continuous web of media as the media moves past the printheads in the system.

Referring to FIG. 6, an inkjet imaging system 5 is shown that has been configured to enable electrical motors used to align printheads to be calibrated with reference to the sensitivity and backlash of the motors. For the purposes of this disclosure, the imaging apparatus is in the form of an inkjet printer that employs one or more inkjet printheads and an associated solid ink supply. However, the motor calibration methods described herein are applicable to any of a variety of other imaging apparatuses that use electromechanical motors or other actuators to align the positions of printheads in the system.

The imaging system includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. Duplex operations may also be achieved with two printers arranged serially with a web inverter interposed between them. In this arrangement, the first printer forms and fixes an image on one side of a web, the inverter turns the web over, and the second printer forms and fixes an image on the second side of the web. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units or modules 21A, 21B, 21C, and 21D, each color module effectively extends across the width of the media and is able to eject ink directly (i.e., without use of an intermediate or offset member) onto the moving media. The arrangement of printheads in the print zone of system 5 is discussed in more detail with reference to FIG. 7. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate timing signals for actuating the inkjet ejectors in the printheads to enable the printheads to eject four colors of ink with appropriate timing and accuracy for registration of the differently color patterns to form color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a color module for each primary color may include one or more printheads; multiple printheads in an module may be formed into a single row or multiple row array; printheads of a multiple row array may be staggered; a printhead may print more than one color; or the printheads or portions thereof can be mounted movably in a direction transverse to the process direction P, also known as the cross-process direction, such as for spot-color applications and the like.

Each of the color modules 21A-21D includes at least one electrical motor configured to adjust the printheads in each of the color modules in the cross-process direction across the media web. In a typical embodiment, each motor is an electromechanical device such as a stepper motor or the like. As used in this document, electrical motor refers to any device configured to receive an electrical signal and produce mechanical movement. Such devices include, but are not limited to, solenoids, stepper motors, linear motors, and the like. One embodiment illustrating a configuration of print bars, printheads, and actuators is discussed below with reference to FIG. 4. In a practical embodiment, a print bar actuator is connected to a print bar containing two or more printheads. The print bar actuator is configured to reposition the print bar by sliding the print bar in the cross-process direction across the media web. Printhead actuators may also be connected to individual printheads within each of color modules 21A-21D. These printhead actuators are configured to reposition an individual printhead by sliding the printhead in the cross-process direction across the media web.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 6, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the electrical motor calibration function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the print bar and printhead motors of color modules 21A-21D in order to adjust the positions of the printhead bars and printheads in the cross-process direction across the media web. Controller 50 is further configured to determine sensitivity and backlash calibration parameters that are measured for each of the printhead and print bar motors, and to store these parameters in the memory. In response to the controller 50 detecting misalignment that requires movement of a print bar or printhead, controller 50 uses the calibration parameter corresponding to the required direction of movement for the appropriate motor to determine a number of steps that the controller commands the motor to rotate to achieve movement of the print bar or printhead in the required direction.

The imaging system 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The optical imaging system may include an array of optical detectors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from unlinked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

Figure 4:
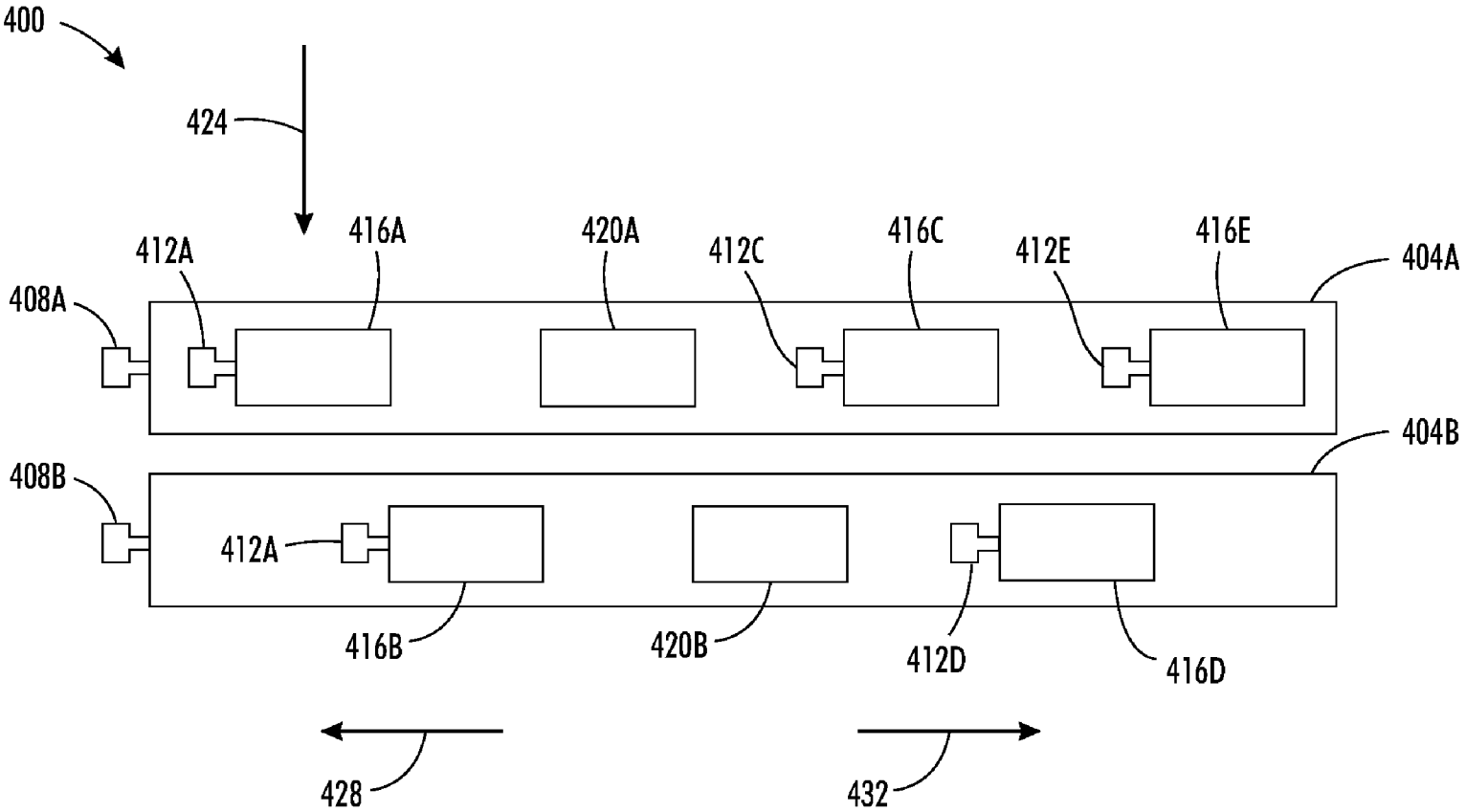
FIG. 4 is a schematic view of a print bar unit that may be used to configure an arrangement of printheads in a print zone of the imaging system of FIG. 6.
Figure 7:
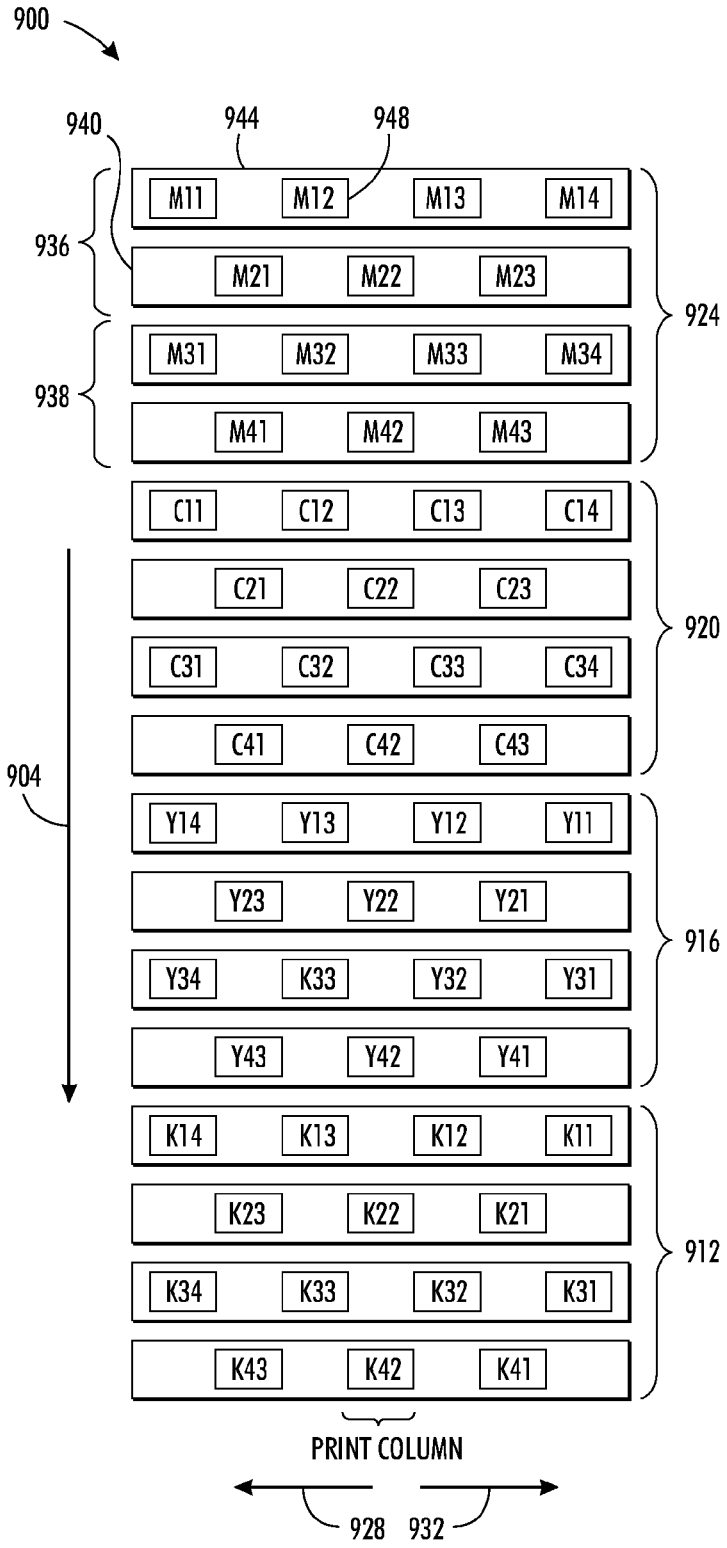
FIG. 7 PRIOR ART
FIG. 7 is a schematic view of a prior art printhead configuration viewed along lines 7-7 in FIG. 6.

A schematic view of a prior art print zone 900 that may be used in the system 5 is depicted in FIG. 7. The print bars and printheads of this print zone may be moved for alignment purposes using the processes described below when the print bars and printheads are configured with actuators for movement of the print bars and printheads as shown in FIG. 4. The print zone 900 includes four color modules or units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as the member travels under the color units from color unit 924 to color unit 912. Each color unit includes two print arrays, which include two print bars each that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print bar array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

FIG. 4 depicts a configuration for a pair of print bars that may be used in a color module of the system 5. The print bars 404A and 404B are operatively connected to the print bar motors 408A and 408B, respectively, and a plurality of printheads 416A-E and 420A, 420B are mounted to the print bars. Printheads 416A-E are operatively connected to electrical motors 412A-E, respectively, while printheads 420A and 420B are not connected to electrical motors, but are fixedly mounted to the print bars 404A and 404B, respectively. Each print bar motor moves the print bar operatively connected to the motor in either of the cross-process directions 428 or 432. Printheads 416A-416E and 420A-420B are arranged in a staggered array to allow inkjet ejectors in the printheads to print a continuous line in the cross-process direction across a media web. Movement of a print bar causes all of the printheads mounted on the print bar to move an equal distance. Each of printhead motors 412A-412E moves an individual printhead in either of the cross-process directions 428 or 432. Motors 408A-408B and 412A-412D are electromechanical stepper motors capable of rotating a shaft, for example shaft 414, in a series of one or more discrete steps. Each step rotates the shaft a predetermined angular distance and the motors may rotate in either a clockwise or counter-clockwise direction. The rotating shafts turn drive screws that translate print bars 404A-404B and printheads 416A-416E along the cross-process directions 428 and 432. As described herein, the measured sensitivity and backlash of motors 408A-408B and 412A-412E is the degree to which the rotation of the motors causes translation of the print bars and printheads along a cross-process direction across the media. The term "sensitivity" refers to the distance a print bar or printhead moves for each step of a corresponding motor. The term "backlash" refers to the degree to which the translation imparted by a motor in a given direction is reduced because reversal of the stepper motor does not result in a translation of the print head until the shaft rotates to a position where the threads and gears between the shaft of the stepper motor and the printhead are in full contact. Thus, backlash occurs in situations where a motor moves in a first direction, and then reverses direction.

While the print bar units of FIG. 4 are depicted with a plurality of printheads mounted to each print bar, one or more of the print bars may have a single printhead mounted to the bar. Such a printhead would be long enough in the cross-process direction to enable ink to be ejected onto the media across the full width of the document printing area of the media. In such a print bar unit, an actuator may be operatively connected to the print bar or to the printhead. A process similar to the one discussed below may then be used to position such a wide printhead with respect to multiple printheads mounted to a single print bar or to other equally wide printheads mounted to other print bars. The actuators in this embodiment enable the inkjet ejectors of one printhead to be interlaced or aligned with the inkjet ejectors of another printhead in the process direction.

Figure 1:
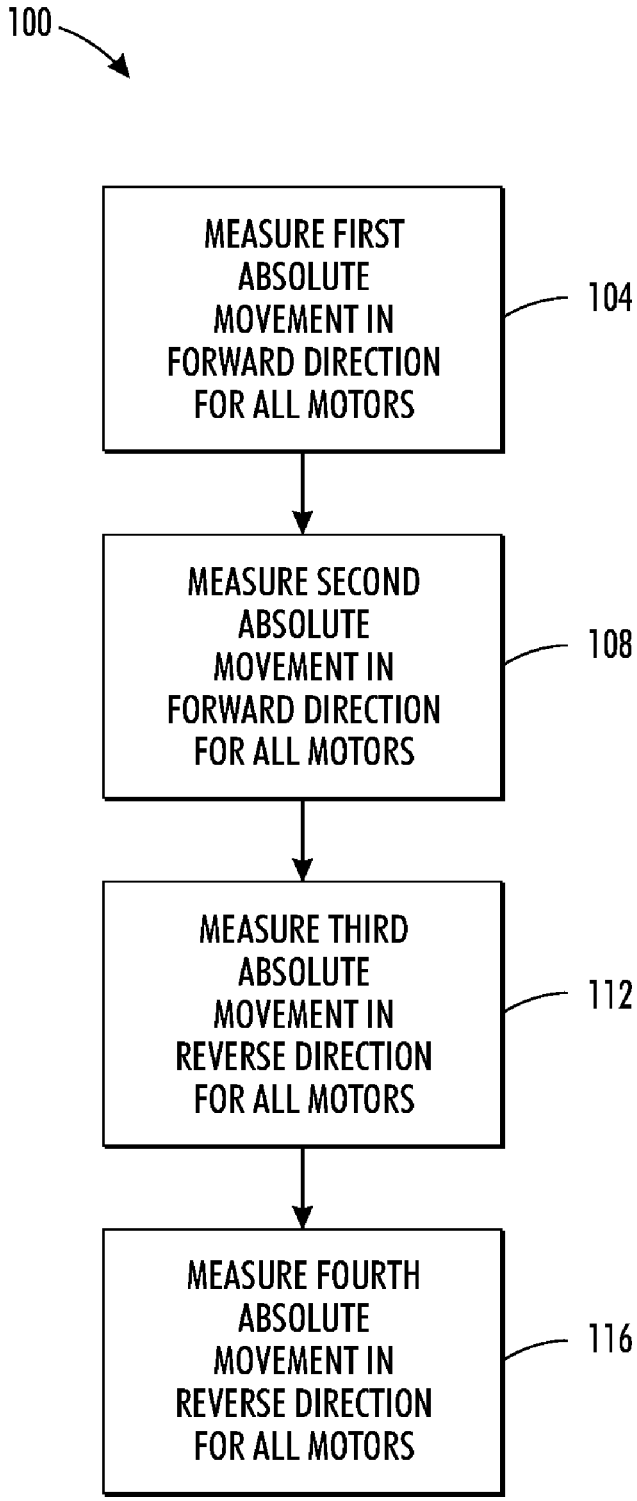
FIG. 1 is a block diagram of a process for determining the sensitivity and backlash of motors in a print bar unit.

Referring to FIG. 1, a block diagram of a process 100 for determining sensitivity and backlash calibration parameters for electrical motors in a print bar unit is depicted. Process 100 begins by moving all print bar and printhead motors in a print bar unit in a first cross-process direction (block 104). The first cross-process direction of movement may be either of cross-process directions 428 or 432. The direction selected is conditioned upon the absolute positions of the print bar and printhead motors. In a situation where the print bar and printhead motors are at or near the extreme range of motion in direction 428, the first cross-process direction of motion is in direction 432, and vice versa.

Following the first cross-process direction movement, the absolute movements of each motor are measured by comparing the positions of markings in registration test patterns formed on the media web (block 108). An appropriate registration test pattern and method of coarse registration is disclosed in U.S. Utility application Ser. No. 12/754,730 hereby entitled "Test Pattern Effective For Coarse Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety.

Figure 5:
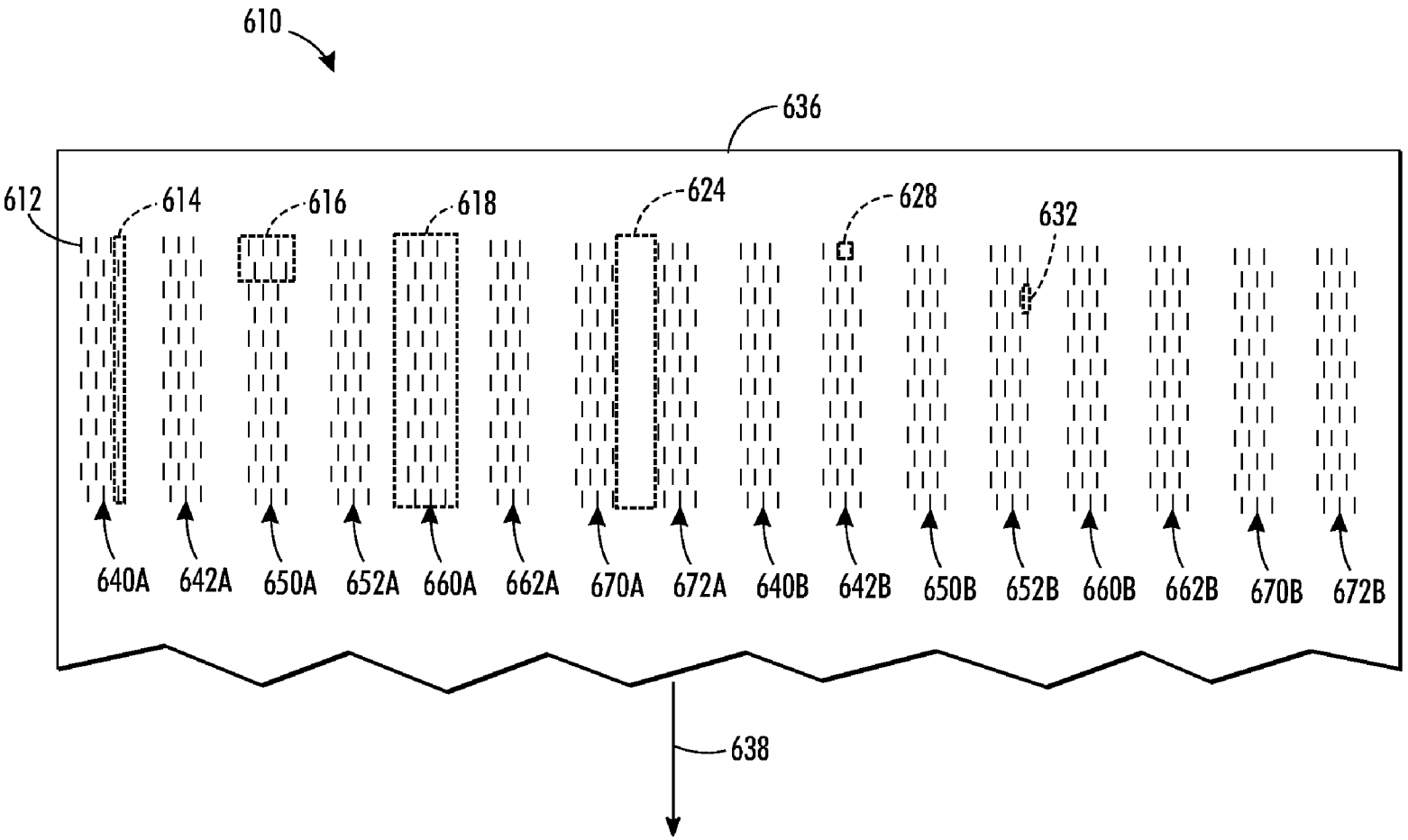
FIG. 5 is an illustration of a printhead calibration test pattern used for evaluation of coarse registration in the system of FIG. 6.

An example of a registration test pattern suitable for use with process 100 is depicted in FIG. 5. Test pattern 610 includes a plurality of arrangements 618 of dashes 612 suitable for printing on an image receiving member 636, which is depicted in the figure as a sheet of paper, although the image receiving member may be a print web, offset imaging member, or the like. The image receiving member 636 moves in the process direction past a plurality of printheads that eject ink onto the image receiving member to form the test pattern 610. The test pattern arrangements 618 are separated from one another by a predetermined horizontal distance 624. Each test pattern arrangement 618 includes a plurality of clusters 616 of dashes 612. Each cluster 616 is printed by a group of inkjet ejectors in a single printhead. A printhead forming a cluster 616 of dashes 612 is operated repeatedly to print a plurality of clusters 616 to form an arrangement 618 of dashes 612. In each column, such as column 614, within an arrangement 618 of dashes 612, a predetermined distance 632 separates each dash 612 in one cluster 616 from a next dash in another cluster 616 of the arrangement 618 in the process direction. In the embodiment shown in FIG. 5, each cluster 616 has six dashes produced by six different ejectors arranged in a single printhead. Each dash 612 is formed with a predetermined number of droplets ejected by an inkjet ejector. Each cluster 616 has two staggered rows of three dashes 612 each, with a predetermined distance 628 separating the dashes 612 in a cluster 616 in the cross-process direction.

The test pattern arrangements 618 depicted in FIG. 5 are further grouped into pairs, with each pair of test pattern arrangements being generated by a different printhead ejecting the same color of ink. Multiple test pattern arrangements 618 may also be used in multi-colored printing systems, such as cyan, magenta, yellow, black (CMYK) systems. In printing systems that interlace two or more printheads that eject the same color of ink to increase the cross-process resolution and that align two or more printheads of different colors to enable color printing, adjacent test pattern arrangements 618 may be generated by printheads ejecting the same color of ink that are shifted by a distance of one-half an inkjet ejector. This shift is sometimes known as interlacing. According to the embodiment of FIG. 5, adjacent test pattern arrangements 640A and 642A are generated by two cyan ink ejecting printheads that are interlaced to increase the cross-process resolution of the cyan printing. Likewise, adjacent test pattern arrangements 640B and 642B are generated by different nozzles on the same two cyan printheads. Test pattern arrangements 640A and 640B are printed by one cyan ink ejecting printhead, while the test pattern arrangements 642A and 642B are printed by a second cyan ink ejecting printhead that is interlaced with the first cyan ink ejecting printhead. In FIG. 5, test pattern groups 650A and 650B are from a first magenta printhead while test pattern groups 652A and 652B are from a second, magenta printhead that is interlaced with the first magenta printhead. The same sequence applies for the printhead producing test pattern groups 660A and 660B and the printhead producing test pattern 662A and 662B for the color yellow. Black ink is produced by the printheads that generate test patterns 670A and 670B and 672A and 672B. The series of test pattern arrangements depicted in FIG. 5 may be repeated across the width of an image receiving member for multiple printheads.

Figure 2:
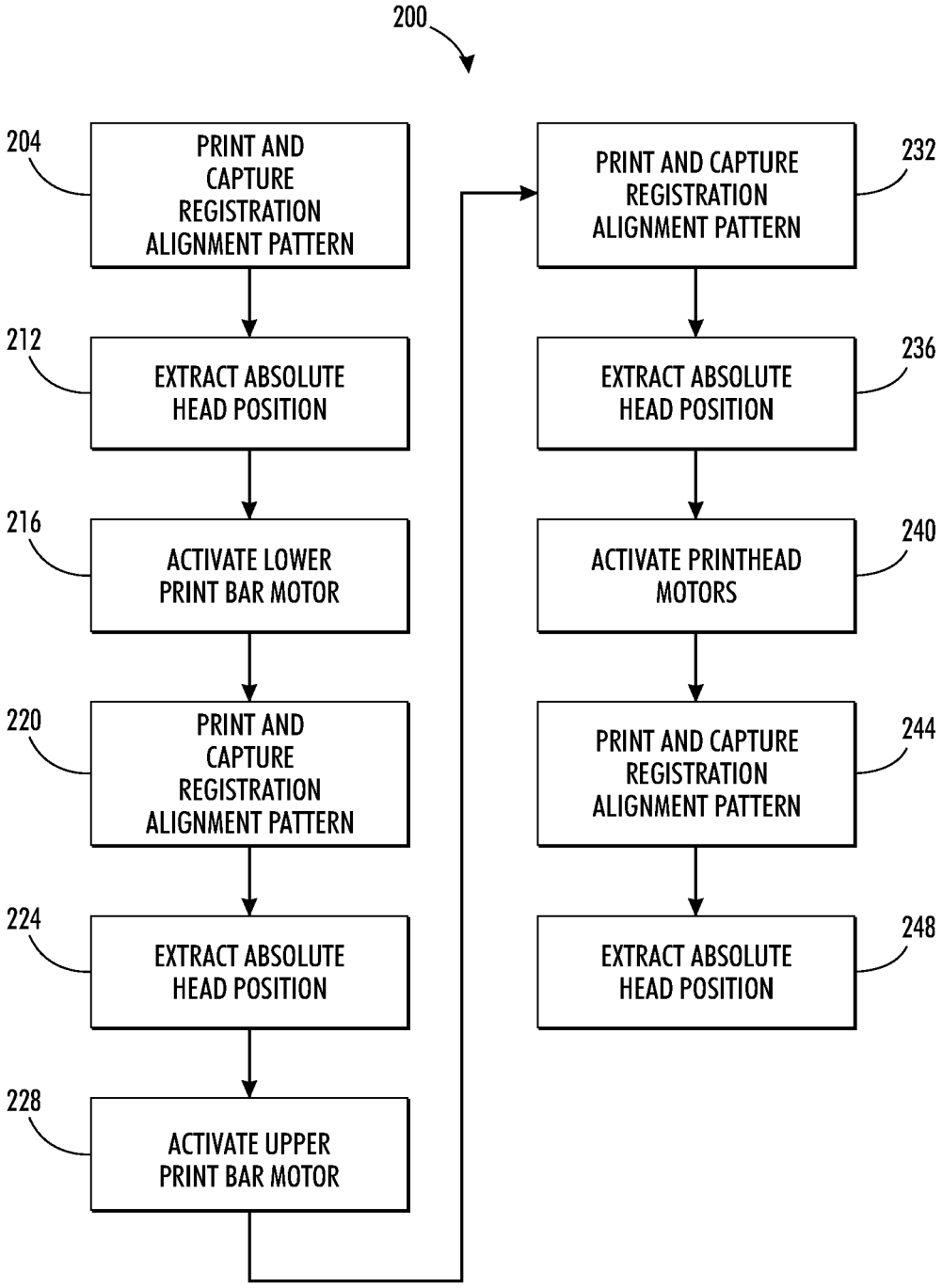
FIG. 2 is a block diagram of a process for determining the absolute degree of movement of motors in a print bar array.

A process for determining the absolute cross-process motion of each print bar printhead driven by operation of a printhead motor is depicted in FIG. 2. Process 200 begins by generating registration test patterns, such as the coarse registration test pattern of FIG. 5, from each of the printheads in a plurality of print bar units for which an electrical motor is calibrated. Image data corresponding to the test pattern printed on the media web are then captured. In one embodiment of a system implementing the process of FIG. 2, an imaging device is used to capture the test pattern image data (block 204). The imaging device may include an array of optical detectors mounted to a bar or other longitudinal structure that extends across the width of an imaging area on the image receiving member in the cross-process direction. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the media web. Once image data corresponding to the test pattern are captured, the absolute position of each printhead in the cross-process direction is determined (block 212). Using the imaging device described above, the position of each printhead can be inferred from the optical detectors that detect the test pattern dashes generated by inkjet ejectors in each printhead. The absolute detected position of each detected printhead may be determined by finding an average position of the optical sensors detecting test pattern dashes generated by each printhead weighted by the cross process positions of the inkjet ejectors printing the dashes. As used in this document, "mean average" and "average" refer to any mathematical technique for calculating, identifying, or substantially approximating a statistical average.

The printhead positions detected by the processing described in block 212 is a combination of the printhead position at the time the dashes were printed and any lateral motion of the paper that occurred between the time the image was printed and the time the image was sensed. Process 200 corrects for this drift by moving only a subset of the printheads, so the other printheads can act as an absolute reference. One embodiment activates the print bar motor for a lower print bar in the print bar unit to move the print bar unit a defined number of steps while the upper print bar remains stationary (block 216). Examples of upper and lower print bar units are print bars 408A and 408B of FIG. 4, respectively. The upper and lower print bars are selected in one embodiment to be in close proximity to one another, minimizing the degree of cross-process media web drift occurring between the two print bars. The registration test pattern is printed with the lower print bar in the new position, and a controller executing programmed instructions that enable data analysis of the image data corresponding to the test pattern markings on the media identifies the new marking positions (block 220). The absolute cross-process test pattern marking positions detected by the controller are then measured for the displacement distance for the new test pattern markings (block 224). In a similar manner to the lower print bar, process 200 next activates the print bar motor for the upper print bar (block 228). The registration test pattern is then reprinted and the image data corresponding to the new test pattern markings on the media are analyzed (block 232). The absolute cross-process test pattern marking positions identified by the controller are then measured for the displacement distance for the new test pattern formed with the upper print bar in the new position (block 236).

Process 200 continues by activating each printhead motor attached to the individual printheads on the upper and lower print bars (block 240). Each printhead motor adjusts the cross-process position of a single printhead by a predetermined number of steps. For each print unit bar, one of the printheads is fixed and provides an absolute reference so the motion of all the other motors are known with reference to this printhead. As with the adjustments made to the print bars, the printheads print the registration test pattern on the media web, and the image data corresponding to the test pattern markings are processed (block 244). The absolute cross-process positions of each marking in the image data are measured by a controller implementing an image data analysis process (block 248).

The test pattern marking positions recorded during process 200 provide relative offsets that cancel the effects of media web drift in the cross-process direction. Thus, the results of process 200 allow for an absolute measure of the cross-process distance that each print bar and printhead moves in response to rotation of a corresponding motor. The absolute motion of the lower print bar from step 216 is determined according to the equation:

$$\Delta x_{2i-1} = \frac{1}{n_{2i-1}} \sum_{j=1}^{n_{2i-1}} (x^a_{2i-1,j} - x^b_{2i-1,j}) - \frac{1}{n_{2i}} \sum_{j=1}^{n_{2i}} (x^a_{2i,j} - x^b_{2i,j})$$

In this equation, $x^b_{2i-1,j}$ is the absolute measured position of printhead j, a printhead on the lower print bar being a member of print bar pair i, before the print bar is moved. The absolute measured position after the lower print bar is moved is $x^a_{2i-1,j}$. The final result of this equation is the sum of the movements of all n printheads in the lower print bar, normalized for the number of printheads, n. The terms in this equation eliminate the effect of paper drift by subtracting the measured change position of the fixed upper print bar unit, seen in the second term of the equation. Similarly, the absolute motion of the upper print bar discussed in the processing of block 228 is determined according to the following equation:

$$\Delta x_{2i} = \frac{1}{n_{2i}} \sum_{j=1}^{n_{2i}} (x^a_{2i,j} - x^b_{2i,j}) - \frac{1}{n_{2i-1}} \sum_{j=1}^{n_{2i-1}} (x^a_{2i-1,j} - x^b_{2i-1,j})$$

Where $x^b_{2i,j}$ is the absolute measured position of printhead j, a printhead on the upper print bar being a member of printhead pair i, before the print bar is moved. The absolute measured position after the upper print bar is moved is $x^a_{2i,j}$. This equation for the upper print bar eliminates the effect of paper drift by subtracting the measured change position of the fixed lower print bar unit, seen in the second term of the equation.

To determine the degree of absolute motion imparted by the individual printhead motors, a single set of printheads are chosen to be fixed reference heads. The motions of all other printheads are measured from these reference heads. In the example of FIG. 4, printheads 420A and 420B may be chosen as reference heads because they are fixed to print bars 404A and 404B, respectively. The degree of movement for each of the individual printhead motors is determined according to the following equations:

$$\Delta x_{2i,j} = (x_{2i,j}{}^a - x_{2i,j}{}^b) - (x_{2i,f}{}^a - x_{2i,f}{}^b)$$

and $$\Delta x_{2i-1,j} = (x_{2i-1,j}{}^a - x_{2i-1,j}{}^b) - (x_{2i-1,f}{}^a - x_{2i-1,f}{}^b)$$

In the first equation, $x_{2ij}$ represents printhead j in the upper print bar i. The printhead being measured has a final measured position of $x^a_{2i,j}$ and initial measured position $x^b_{2i,j}$. This equation also negates the difference in measured position of the reference printhead between the final measured position of $x^a_{2i,f}$ and initial measured position $x^b_{2i,f}$. The next equation similarly calculates the absolute change in position for a printhead motor in the lower print bar i−1. As used in this document, the words "calculate" and "identify" include the operation of a circuit comprised of hardware, software, or a combination of hardware and software that reaches a result based on one or more measurements of physical relationships with accuracy or precision suitable for a practical application.

Referring again to FIG. 1, process 100 continues by repeating the measurement of forward motor motion a second time (block 108). The repetition uses process 200 a second time to measure the absolute degree of printhead and print bar translation imparted by the motors. The repeated measurement of forward motion ensures that residual backlash that may affect the measured motions from the first forward movement does not affect the measured motions from the second forward movement. Process 100 repeats the movement and measurement steps of process 200 a third time in the reverse direction by having the controller operate the motors to rotate in the reverse direction (block 112). The reverse movement and measurement steps of process 200 are then repeated and measured a fourth time (block 116).

Process 100 determines the sensitivity of how much each printhead moves in response to a printhead or print bar motor being activated for a given number of steps. The sensitivity of each motor is determined according to the following equation:

$$S_m = \frac{1}{2}\left(\frac{\Delta x_{m2}}{N_{m2}} + \frac{\Delta x_{m4}}{N_{m4}}\right)$$

where $\Delta x_{m2}$ and $\Delta x_{m4}$ are the absolute motor movements measured at the processing discussed in blocks 108 and 116, respectively, and $N_{m2}$ and $N_{m4}$ are the number of motor steps that each motor is moved during the processing discussed in blocks 108 and 116, respectively.

Process 100 also determines the degree of backlash for each motor. The degree of backlash for each motor is determined according to the equation:

$$\Delta x_b = \Delta x_{m4} - \Delta x_{m3}$$

where $\Delta x_{m4}$ is the fourth motor movement measured at the processing described in block 116, and $\Delta x_{m3}$ is the third motor movement measured after reversing direction at the processing discussed in block 112.

The sensitivity and backlash values calculated in process 100 are stored in a memory in the printer permitting calibration for each motor. In subsequent processes, the sensitivity and backlash data are used to determine a number of steps that a controller needs to use for each motor move a print bar or printhead to a desired position. The sensitivity and backlash information may be combined with a history of previous motor movements stored in the memory to determine how many steps a motor should take to carry out a desired print bar or printhead movement. As an example, a controller may determine that print bar 404A from FIG. 4 is to be moved 50 μm in cross-process direction 432. The history of motor movements indicates that motor 408A has previously moved 20 μm in cross-process direction 428, a distance sufficient to incur backlash by reversing cross-process directions. The number of steps N that motor 408A should take is determined by the equation:

$$N = \frac{\Delta x_T}{S_m} + \frac{\Delta x_b}{S_m}$$

where $\Delta x_T$ is the desired target cross-process displacement, $S_m$ is the measured sensitivity for the motor, and $\Delta x_b$ is the measured backlash for the motor. Since the motor is adjusted by an integral number of steps, N is rounded to the nearest integer if the equation produces a non-integer result. In situations where the motor is not reversing direction, $\Delta x_b$ is set to zero. Use of a backlash calibration parameter of 5 μm and a sensitivity calibration parameter of 3 μm/step in the equation above results in a commanded motor rotation of 18 steps producing a cross-process motion of 49 μm.

Figure 3:
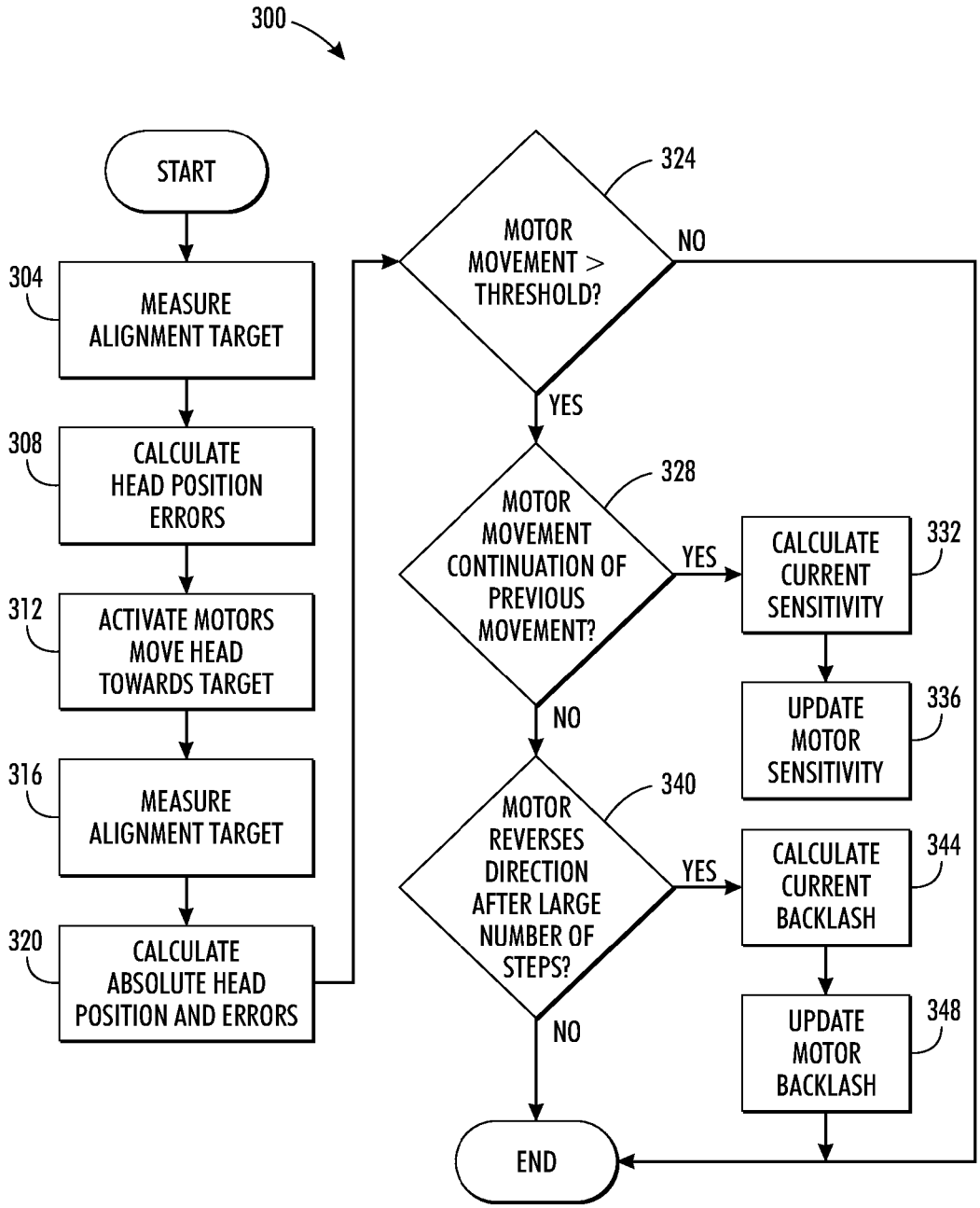
FIG. 3 is a block diagram of an alternative process for determining the sensitivity and backlash of motors in a print bar unit.

Referring to FIG. 3, an alternative process 300 for measuring the sensitivity and backlash of print bar and printhead motors is depicted. Process 300 may be referred to as opportunistic calibration since it measures the sensitivity and backlash of print bar and printhead motors during the printhead registration process. The printhead registration process occurs prior to each print job processed by the printer, and registration often involves multiple movements of the print bar and printhead motors. Process 300 takes advantage of these operations to measure the sensitivity and backlash in some of the motor movements.

Process 300 begins by printing a test pattern, such as test pattern 500, and performs a registration process measuring the positions of test pattern markings in the image data generated by the optical imaging system (block 304), and determining the errors present between the detected positions and the expected positions of aligned printheads (block 308). In response to the measured alignment errors, the print bar and printhead motors are commanded to move a certain number of steps towards the expected positions (block 312). For each motor activated in accordance with the processing of block 312, the absolute degree of movement is measured (block 316). Each printhead motor movement may be determined using the equations for printhead motor movement discussed above. For print bar motor movements, the absolute distance may not be calculated directly. However, the absolute movement may be estimated by taking the difference between the average printhead position of the printheads in the print bar unit to the average of all printheads in the remaining print bar units measured both before and after the movement of occurring from the processing of block 312. In another embodiment, one printhead always remains fixed and may be used as an absolute reference.

Measurements of printhead and print bar motor movements taken during the registration process are subject to noise. The degree to which noise affects the accuracy of the measured movement distance increases as the distance of the movement decreases. Therefore, measured distances that fall below a predetermined threshold distance are ignored in order to avoid calibrating motor sensitivity and backlash with false values (block 324). The predetermined threshold distance is determined with reference to the resolution of the electrical motors being used and the corresponding travel distance of a printhead. If the degree of movement exceeds the predetermined threshold, then the type of motion that the motor underwent is analyzed. A history of previous movements that each print bar and printhead motor has performed may be stored in a memory in the printer. This history includes the direction and number of steps of previous movements that each motor has performed. If the movement occurring during the processing of block 312 commands a motor to continue in the same direction as the most recent previous movement, and if the previous movement was of a greater distance than the backlash distance calibrated for the motor (block 328), then the current sensitivity of the motor is measured by dividing the measured movement distance by the number of movement steps taken (block 332). The calculated sensitivity is then stored in the memory to update the calibration of future movements when the motor is commanded to continue moving in a given cross-process direction (block 336).

When a motor has a history indicating that the movement occurring during the processing of block 312 is the reverse of the direction of previous movements that were of sufficient distance to impart a backlash (block 340), then the backlash measured for the current move is measured (block 344). The measured backlash is shown in the equation:

$$\Delta x_b = SN - \Delta x_m$$

where S is the sensitivity calibration for the motor, N is the number of steps from the movement command in the processing of block 312, and $\Delta x_m$ is the actual distance covered by the movement. The measured backlash is stored in the memory to update the calibration for future movements when the motor is commanded to reverse directions on the cross-process axis (block 348).

In operation, the printheads of a print zone in a printing system are arranged in an appropriate manner to eject ink onto media as the media passes through the print zone. The print bars and some of the printheads are operatively connected to actuators that are operatively connected to one or more controllers configured to operate the actuators and printheads. The controller then operates the printheads from time to time to eject ink onto the media in a test pattern. Image data of the test pattern on the media is received by the controller and processed to identify the positions of the printheads and measure alignment errors in the cross-process direction. After the controller generates commands for operating the actuators to move the printheads for realignment of the printheads, the commands are adjusted using the calibration parameters stored for the actuators that correspond to the direction in which the actuators are to be operated. The commands are delivered to the actuators and the actuators respond by moving the printheads. The printheads may then be operated to eject another test pattern and the image data corresponding to the test pattern on the media may be received and processed by the controller. Differences between the actual positions of the printheads identified from the image data and the intended positions of the printheads may be used to update the calibration parameters for the operated actuators. Additional iterations of the process may be performed as determined by the controller processing the image data corresponding to test patterns on media.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for calibrating electrical motors that move printheads in a printer comprising:

generating a first plurality of dashes on media with a plurality of printheads as the media moves past the plurality of printheads;

identifying a first position for each printhead in the plurality of printheads from image data of the first plurality of dashes;

operating at least one electrical motor operatively connected to at least one of the printheads in the plurality of printheads to move the at least one printhead in a first direction in the cross-process direction by a predetermined distance;

generating a second plurality of dashes on media with the plurality of printheads as the media moves past the plurality of printheads;

identifying a second position for each printhead in the plurality of printheads from image data of the second plurality of dashes;

comparing the second position of the at least one printhead with the first position of the at least one printhead to measure a distance moved by the at least one printhead;

identifying a first calibration parameter for the at least one electrical motor with reference to the predetermined distance and measured distance; and operating the at least one electrical motor with reference to the first calibration parameter.

2. The method of claim 1 further comprising:

comparing the second position of at least one other printhead with the first position of the at least one other printhead to measure a distance moved by the media in the cross-process direction during generation of the second plurality of dashes, the at least one other printhead having fixed position with reference to the one printhead; and identifying the calibration parameter for the at least one electrical motor with reference to the predetermined distance, the measured distance, and the distance moved by the media in the cross-process direction.

3. The method of claim 1 further comprising:

operating the at least one electrical motor operatively connected to the at least one printhead to move the at least one printhead in a second direction in the cross-process direction by a second predetermined distance;

generating a third plurality of dashes on media with the plurality of printheads as the media moves past the plurality of printheads;

identifying a third position for each printhead in the plurality of printheads from image data of the third plurality of dashes;

comparing the third position of the at least one printhead with the second position of the at least one printhead to measure a distance moved by the at least one printhead in the second direction; and identifying a second calibration parameter for the at least one electrical motor with reference to the second predetermined distance and measured distance moved in the second direction.

4. The method of claim 1 further comprising:

comparing the third position of at least one other printhead with the second position of the at least one other printhead to measure a distance moved by the media in the cross-process direction during generation of the third plurality of dashes; and identifying the second calibration parameter for the at least one electrical motor with reference to the second predetermined distance, the measured distance in the second direction, and the distance moved by the media.

5. The method of claim 1 wherein the first plurality of dashes and the second plurality of dashes are arrangements of dashes ejected onto the media substrate, each arrangement of dashes having a predetermined number of rows and a predetermined number of columns, each dash in a row of dashes within an arrangement of dashes being separated by a first predetermined distance that corresponds to a distance in a cross-process direction between each inkjet ejector that ejected ink for a dash in a row of dashes and each dash in a column of dashes in the arrangement of dashes being separated by a second predetermined distance, each dash in a column of an arrangement of dashes being ejected by a single inkjet ejector in a printhead of the inkjet printer; and a plurality of unprinted areas interspersed between the plurality of arrangements of dashes.

6. A method for calibrating electrical motors that move printheads in a printer comprising:

generating a first plurality of dashes on media with a plurality of printheads as the media moves past the plurality of printheads in a process direction;

identifying a first distance between a first identified position for each printhead in the plurality of printheads that is identified from image data of the first plurality of dashes and a target position for each printhead in the plurality of printheads;

operating a plurality of electrical motors operatively connected to printheads in the plurality of printheads to move printheads in the plurality of printheads from the first identified positions to the target positions by the first distance identified for each printhead, the printhead movement being in a first direction in a cross-process direction;

generating a second plurality of dashes on media with the plurality of printheads as the media moves past the plurality of printheads in the process direction;

identifying a second distance moved by each printhead for which an electrical motor was operated to move the printhead from image data of the second plurality of dashes, the identified second distance being between a second identified position for each printhead in the plurality of printheads that is identified from image data of the second plurality of dashes and the first identified position for each printhead in the plurality of printheads;

identifying a first calibration parameter for each electrical motor used to move a printhead, the first calibration parameter being identified with reference to the first distance and the identified second distance; and operating the electrical motors for which a first calibration parameter was identified with reference to the first calibration parameter.

7. The method of claim 6, the second distance identification further comprising:

identifying electrical motors that are operatively connected to more than one printhead and that were operated to move printheads by the first distance;

identifying the second distance as a difference between an average position of the more than one printhead moved by an identified electrical motor and an average position of all other printheads in the plurality of printheads before and after operation of the electrical motors to move printheads by the first distance.

8. The method of claim 6 further comprising:

comparing an identified first distance to a predetermined threshold; and identifying the second distance in response to the identified first distance being equal to or greater than the predetermined threshold.

9. The method of claim 6, the identification of a first calibration parameter for an electrical motor further comprising:

identifying the first calibration parameter with reference to the first distance, the measured distance, and a previously identified first calibration parameter for the electrical motor.

10. The method of claim 6 further comprising:

identifying a distance moved by a printhead that is not moved with operation of an electrical motor, the distance being measured with reference to image data for the first plurality of dashes and the second plurality of dashes; and identifying the first calibration parameter for an electrical motor with reference to the first distance, the distance measured for the printhead moved by the electrical motor, and the distance moved by the printhead not moved with operation of an electrical motor.

11. The method of claim 6 further comprising:

operating at least one electrical motor operatively connected to at least one printhead to move the at least one printhead in a second direction in the cross-process direction by a second distance;

generating a third plurality of dashes on media with the plurality of printheads as the media moves past the plurality of printheads in the process direction;

identifying a third position for each printhead in the plurality of printheads from image data of the third plurality of dashes;

comparing the third position of the at least one printhead with the second position of the at least one printhead to measure a distance moved by the at least one printhead in the second direction; and identifying a second calibration parameter for the at least one electrical motor with reference to the second distance and the measured distance moved by the at least one printhead in the second direction.

12. The method of claim 6 further comprising:

comparing the third position of at least one other printhead with the second position of the at least one other printhead to measure a distance moved by the media in the cross-process direction during generation of the third plurality of dashes; and identifying the second calibration parameter for the at least one electrical motor with reference to the second distance, the measured distance moved by the at least one printhead in the second direction, and the distance moved by the media.

13. The method of claim 6 wherein the first plurality of dashes and the second plurality of dashes are arrangements of dashes ejected onto the media substrate, each arrangement of dashes having a predetermined number of rows and a predetermined number of columns, each dash in a row of dashes within an arrangement of dashes being separated by a first predetermined distance that corresponds to a distance in a cross-process direction between each inkjet ejector that ejected ink for a dash in a row of dashes and each dash in a column of dashes in the arrangement of dashes being separated by a second predetermined distance, each dash in a column of an arrangement of dashes being ejected by a single inkjet ejector in a printhead of the inkjet printer; and a plurality of unprinted areas interspersed between the plurality of arrangements of dashes.

14. A printer comprising:

a media transport that is configured to transport media through the printer in a process direction;

a plurality of printheads configured to eject ink onto media being transported past the plurality of printheads by the media transport;

at least one electrical motor operatively connected to at least one printhead in the plurality of printheads;

an imaging device mounted proximate to a portion of the media transport to generate image data corresponding to a cross-process portion of the media being transported through the printer in the process direction after the media has received ink ejected from the printheads; and a controller operatively connected to the imaging device, the at least one electrical motor, and the plurality of printheads, the controller being configured to operate the printheads to eject ink onto media to form a first plurality of dashes as the media is being transported past the printheads on the bars, to receive image data of the media and the ink ejected onto the media generated by the imaging device, to operate the at least one electrical motor to move the at least one printhead in a cross-process direction with reference to the media in a first direction, and to process the image data to identify a first calibration parameter for the at least one electrical motor with reference to a first position for the at least one printhead that is identified before the at least one electrical motor is operated to move the at least one printhead and to a second position for the at least one printhead that is identified after the at least one electrical motor is operated to move the at least one printhead.

15. The printer of claim 14 wherein the controller is configured to operate the printheads to eject ink onto the media in a test pattern arrangement that is comprised of a plurality of arrangements of dashes ejected onto the media substrate, each arrangement of dashes having a predetermined number of rows and a predetermined number of columns, each dash in a row of dashes within an arrangement of dashes being separated by a first predetermined distance that corresponds to a distance in a cross-process direction between each inkjet ejector that ejected ink for a dash in a row of dashes and each dash in a column of dashes in the arrangement of dashes being separated by a second predetermined distance, each dash in a column of an arrangement of dashes being ejected by a single inkjet ejector in a printhead of the inkjet printer, and a plurality of unprinted areas interspersed between the plurality of arrangements of dashes.

16. The printer of claim 14 wherein the plurality of printheads are staggered to enable printheads that eject ink onto media moving in a process direction after other printheads eject ink onto the media moving in the process direction to form a continuous line on the media in the cross-process direction; and at least one electrical motor is operatively connected to more than one printhead in the cross-process direction to move the more than one printheads in the cross-process direction.

17. The printer of claim 14 further comprising:

a plurality of members that extend across a portion of the media transport in a cross-process direction that is orthogonal to the process direction, each member having a number of printheads mounted to the member and spaced from one another in the cross-process direction, the printheads on adjacent members in the process direction being configured to print a contiguous line across media being transported through the printer in the process direction; and a plurality of electrical motors, each member having at least one electrical motor operatively connected to the member to translate the member in the cross-process direction and each member having at least one electrical motor that is operatively connected to only one printhead mounted on the member to translate the printhead in the cross-process direction.

18. The printer of claim 17 wherein the controller is further configured to operate at least one of the electrical motors operatively connected to one of the members to move the at least one member and the printheads mounted to the member in a cross-process direction with reference to the media in the first direction, and to process the image data to identify the first calibration parameter for the at least one electrical motor with reference to first positions for the printheads mounted to the member that are identified before the at least one electrical motor is operated to move the member and the printheads mounted to the member and to second positions for the printheads that are identified after the at least one electrical motor is operated to move the member and the printheads mounted to the member.

19. The printer of claim 18 wherein the controller is further configured to operate the at least one electrical motor operatively connected to one of the members to move the at least one member and the printheads mounted to the member in a cross-process direction with reference to the media in a second direction, and to process the image data to identify a second calibration parameter for the at least one electrical motor with reference to the second positions for the printheads mounted to the member and to third positions for the printheads that are identified after the at least one electrical motor is operated to move the member and the printheads mounted to the member in the second direction.

20. The printer of claim 19 wherein the controller is further configured to operate the electrical motor operatively connected to only one of the printheads mounted to the member in a cross-process direction with reference to the media in the first direction, and to process the image data to identify the first calibration parameter for the operated electrical motor with reference to a first position for the printhead operatively connected to the electrical motor that is identified before the electrical motor is operated to move the printhead and to a second position for the printhead operatively connected to the electrical motor that is identified after the electrical motor is operated to move the printhead operatively connected to the electrical motor.

21. The printer of claim 20 wherein the controller is further configured to operate the electrical motor operatively connected to only one of the printheads mounted to the member in a cross-process direction with reference to the media in the second direction, and to process the image data to identify the second calibration parameter for the operated electrical motor with reference to the second position for the printhead operatively connected to the electrical motor and to a third position for the printhead operatively connected to the electrical motor that is identified after the electrical motor is operated to move the printhead operatively connected to the electrical motor in the second direction.

* * * * *